United States Patent [19]

Trull et al.

[11] Patent Number: 4,765,163

[45] Date of Patent: Aug. 23, 1988

[54] FRONT-LOADED KNOB ASSEMBLY

[75] Inventors: Jeffrey G. Trull, Matthews; David Dixon, Monroe, both of N.C.

[73] Assignee: Yale Security Inc., Monroe, N.C.

[21] Appl. No.: 40,194

[22] Filed: Apr. 20, 1987

[51] Int. Cl.[4] ..... E05B 13/10

[52] U.S. Cl. ..... 70/224; 70/207; 70/209; 70/DIG. 39

[58] Field of Search ..... 70/224, 207, 209, DIG. 39

[56] References Cited

U.S. PATENT DOCUMENTS

| | | | |
|---|---|---|---|
| 2,008,668 | 7/1935 | Gold | 70/224 |
| 2,027,731 | 1/1936 | Holpfer | 70/91 |
| 2,079,583 | 5/1937 | Brauning | 70/224 |
| 2,719,424 | 10/1955 | Rayburn | 70/224 |
| 3,190,684 | 6/1965 | Russell | 70/224 X |
| 3,196,645 | 7/1965 | Russell | 70/224 |
| 3,212,305 | 10/1965 | Russell et al. | 70/224 |
| 3,308,641 | 3/1967 | Russell et al. | 70/224 |
| 3,955,387 | 5/1976 | Best et al. | 70/224 |
| 4,320,637 | 3/1982 | Wu | 70/224 |
| 4,672,829 | 6/1987 | Gater et al. | 70/224 X |

*Primary Examiner*—Gary L. Smith
*Assistant Examiner*—Suzanne L. Dino
*Attorney, Agent, or Firm*—Dallett Hoopes

[57] ABSTRACT

The front half of the knob shell and the cylinder are removable from the rest of the lockset without special skill or tools so that cylinder may be replaced or rekeyed. A radial retainer pin in the cylinder assembly extends outward into the lockset shank to hold the cylinder in place. When key is turned counterclockwise, the retainer pin may be depressed inward into a radial recess in the cylinder plug so that cylinder and knob front can be removed from the lockset. A recess in the plug has a spring-biased cover and forces the retainer pin back outward when the pin is released.

2 Claims, 1 Drawing Sheet

Fig. 1
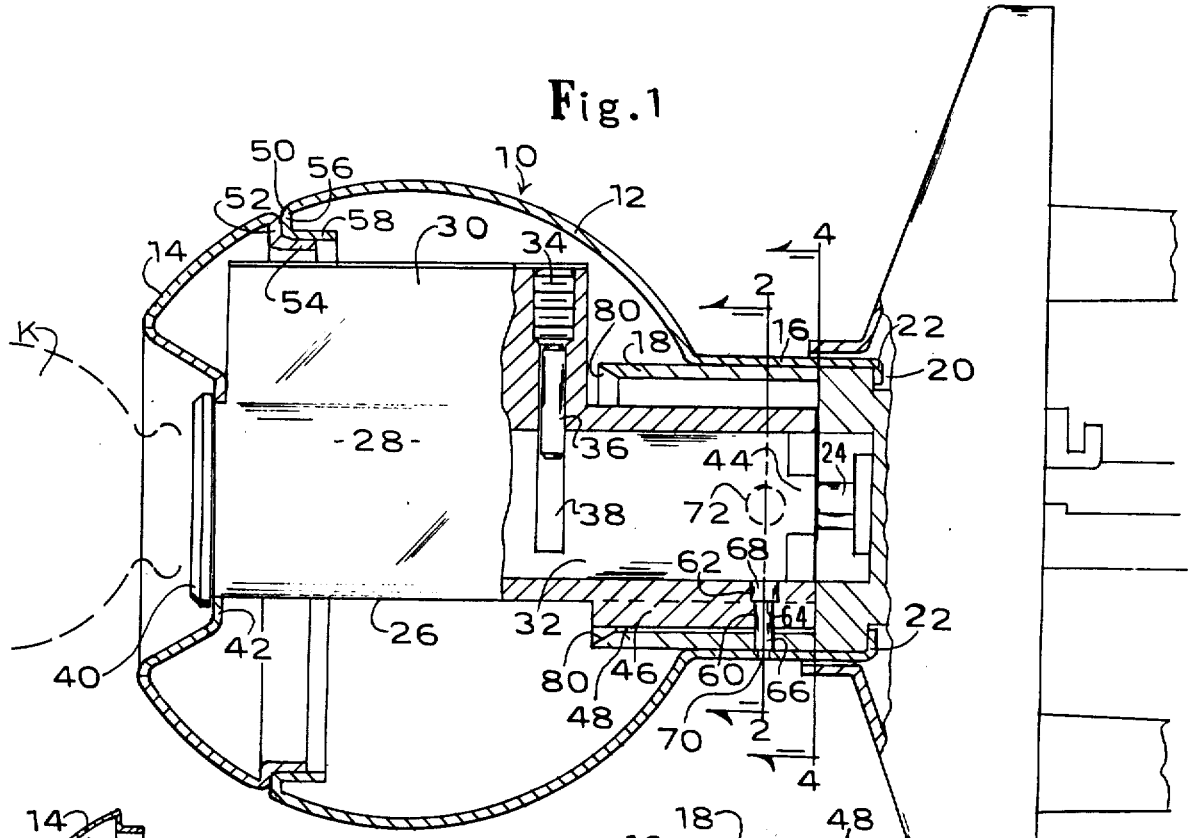
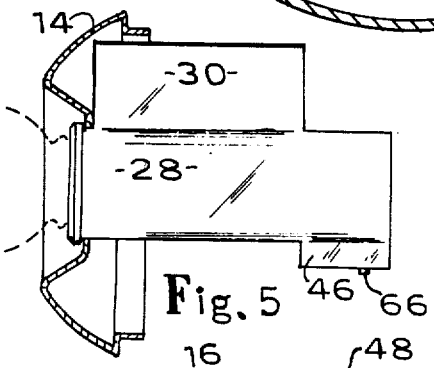
Fig. 5
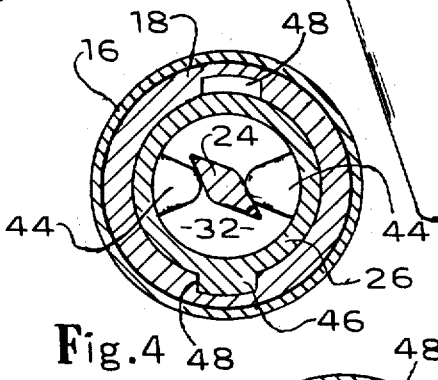
Fig. 4
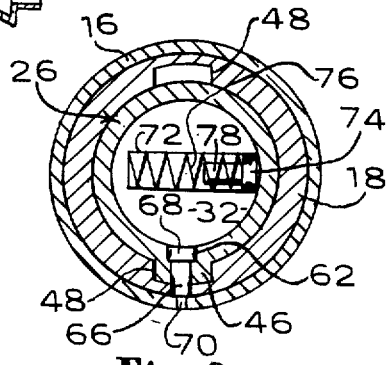
Fig. 2
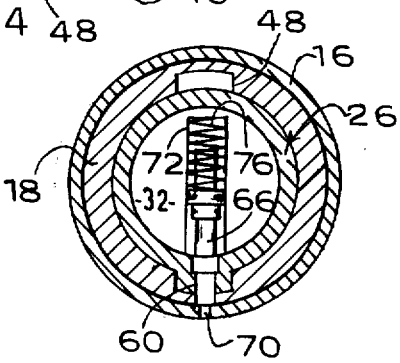
Fig. 3

FRONT-LOADED KNOB ASSEMBLY

BACKGROUND OF THE INVENTION

1. Field of the Invention

This invention relates to a front-loaded knob assembly for a lockset. More specifically, this invention relates to a knob assembly in which the front half of the knob together with the lock cylinder can be removed out of the lockset for the purpose of replacing the lock cylinder with a cylinder of different keying characteristics or rekeying the existing cylinder.

2. Description of the Prior Art

In the prior art there are disclosures of locksets having removable cylinders. An example is the U.S. Pat. No. 2,027,731 to Holpfer, which issued Jan. 14, 1936. In this earlier patent the removable key cylinder and faceplate of the knob is held in place in the knob by a spring-pressed pin disposed in a radial recess in the end of the cylinder plug and having an outward end which as the plug is turned by the key moves about an inwardly facing annular groove formed in the knob hub. In one position the pin end appears through a tiny radial pin access opening in the knob so that a pointed tool may be inserted through the opening to depress the pin into its recess in the cylinder plug, and so that the cylinder may be axially removed out of the knob. The cylinder housing is normally keyed to the knob by one or more longitudinal pins spaced outward from the axis.

SUMMARY OF THE INVENTION

One of the drawbacks of earlier devices is the difficulty experienced in aligning the radial retaining pin end which rotates with the cylinder plug with the tiny opening in the knob hub. The present invention contemplates an arrangement whereby the retaining pin is not on the cylinder plug but instead is on the cylinder housing which rotates as a unit with the knob, and hence the retaining pin never leaves the pin access opening as the key is turned. The cylinder plug is formed with a relatively large radial recess which may be closed by a spring-pressed cover, which recess is turned as the key is turned and is readily aligned with the aforementioned retaining pin. To remove the cylinder it is merely necessary to turn the key counterclockwise—that is, opposite from the normal direction of turning—to align the recess in the plug with the retaining pin. The retaining pin may then be depressed from the outside of the knob so that it clears the knob shank, and the cylinder and half the knob may be removed.

BRIEF DESCRIPTION OF THE DRAWINGS

Other objects and features of the invention will be apparent from the study of the following specification including drawings, all of which show a non-limiting form of the invention.

In the drawings:

FIG. 1 is a side elevational view, partly in section showing a knob assembly embodying the invention;

FIG. 2 is a sectional view taken in the plane of the line 2—2 of FIG. 1;

FIG. 3 is a sectional view similar to FIG. 2 but showing the cylinder rotated 90 degrees counterclockwise and showing the retaining pin being depressed;

FIG. 4 is a sectional view taken on the line 4—4 of FIG. 1; and

FIG. 5 is a reduced side elevation of the outer knob shell half and the cylinder after removal from the lockset.

DESCRIPTION OF THE PREFERRED EMBODIMENT

The knob assembly embodying the invention is shown in FIG. 1 and generally designated 10. It comprises an inner knob shell half 12 and a front or outer knob shell half 14. As shown, the inner half is necked down as at 16 and fixedly mounted on the shank 18. The shank is formed with a peripheral groove as at 20, and mounted for rotation in the lockset assembly by means not shown and not part of this invention. The inner knob shell is crimped over the edge of the recess 20 as at 22. Concentric with the mounting of the shank is the mounting of the lock spindle 24, which, as shown in FIG. 4, may be of diamond-shape in cross section to establish a driving connection with the locking mechanism 26.

The locking mechanism comprises a cylinder 28 having the upstanding conventional bible 30 and containing the conventional plug 32. Aside from the usual pin tumblers, the bible 30 also contains the set screw 34 and the retaining element 36 which fits into the peripheral groove 38 of the plug 32. The front end of the plug is formed with the usual key-receiving end plate 40. As shown the bible 30 and the end plate 40 sandwich between them the margin 42 of the cylinder receiving opening of the outer half 14 of the knob. Key K is shown in dotted lines.

On the inner end of the plug is formed inward diametrically opposed projections 44, which engage the spindle 24 of the locking mechanism so that when the key K is turned the projections 44 on the plug will turn the spindle 24. The shapes of the projections 44 and spindle 24 are such as to allow for appropriate lost motion, as is conventional.

Keying the cylinder for rotation with the shank 18 is the longitudinal rib 46 on the outside of the cylinder 26. Depending on the hand of the door, rib 46 fits in one of the keyways 48 in the shank (FIG. 4).

The two halves 12 and 14 of the knob shell are formed at their juncture 50 so as to leave only a single line of joint visible from the outside. The outer half is formed with an inward flange 52 which is bent rightwardly, as shown in FIG. 1, to form an outwardly facing land 54. Similarly the inward half 12 is formed with an inward flange 56 and a rightwardly extending inward facing land 58. Lands 54 and 58 are of such a dimension as they may snugly interfit in a friction fit.

Turning to an essential area of the invention, it will be noted that the shank 18 is formed with a radial opening 60, which is enlarged at its upper end 62 and presents a shoulder 64. Into this opening fits the retaining pin 66, having the head 68 which butts outwardly against shoulder 64. The shell half 12, where it is necked, is formed with a small opening 70 in alignment with the shank opening 60. In the same radial plane with the retaining pin is a blind recess 72 in the plug 32. This recess is formed with a cover 74 (FIG. 2) which is pressed outward by an axial spring 76. The cover 74 is slideable inwardly and may be of the same approximate shape as the retaining pin 66, having a reduced stem 78. Preferably the head on retaining pin 66 and its surrounding opening 62 is smaller than the cover 74, so that should the retaining pin 66 be absent the cover 74 will not be able to lodge in the opening 62 and jam the plug against rotation within the cylinder.

The operation of the device will be apparent from the drawings. Suffice it to say, a counterclockwise turn for 90 degrees of the key K (clockwise in FIG. 2) will cause the cover 74 and recess 72 to align with the pin 66 (FIG. 3). Thereafter upward pressure on the retaining pin 66 as by a tool or paper clip will cause the spring 76 to yield and permit retaining pin 66 to move entirely within the rib 46 so that the smaller end of the retaining pin 66 no longer is disposed in the part of the opening 60 which is in the shank 18. This permits the cylinder 28 and the outer half 14 to be removed outwardly from the lockset. Once this is accomplished, the retaining element 36 may be withdrawn from the angular peripheral groove 38 by backing off on set screw 34. Subsequently the plug 32 may be withdrawn and the outer half 14 of the knob removed from the cylinder. This permits the cylinder 28 to be replaced with another having different key characteristics.

Reassembly is simple. With the key in its counterclockwise extreme position, the cylinder having the retaining pin 66 protruding thereout may be shoved, together with the outer half 14, into the knob. For this purpose the keyway 48 is formed with a beveled lead-in 80 which, as the cylinder is shoved rightwardly (FIG. 1), depresses the retaining pin 66 and retaining pin 66 springs out again only after it latches into the opening 60 in the shank 18.

It may be seen that the present invention offers an extremely simple and easy to accomplish removal of the cylinder and its replacement. An advantage is that the retaining pin 66 is always available to the opening 70 irrespective of the position of the key K and plug 32. Hence there is no difficulty in aligning the pin 66 with the opening 70. At the same time, the recess 22 and the plug 32 are readily alignable with the retaining pin 66.

While the invention has been shown in only one form, it may be used in many different embodiments, and the desired protection is defined by the following claim language and its equivalents.

I claim:

1. A front-loaded knob assembly for a lockset comprising a tubular knob shank, an inner knob shell half fixedly secured about the outside of the knob shank, a tubular lock cylinder axially disposed in the outer end of the knob shank, the cylinder being keyed for rotation with the shank, a cylinder plug rotatably disposed in the cylinder and adapted to cooperate with a key and pin tumblers in the cylinder in the conventional way, the plug having lock spindle drive means on its inner end, the cylinder having secured thereto the outer knob shell half normally mating with the outer end of the inner knob shell half, the cylinder having a radial opening therein, the shank and the inner half of the knob having a radial opening aligned with the radial opening in the cylinder, the opening in the cylinder being diametrically enlarged in its inner side to form an annular shoulder facing radially inward, and retaining pin means extending through the radial openings in the shank and cylinder normally locking the cylinder against longitudinal displacement, the retaining pin means having an inward enlargement butting against the annular shoulder, the inner end of the plug having a radial recess larger in diameter than the pin means, and removable means preventing axial relative movement between the plug and cylinder, the pin being always accessible to the outside of the knob but is only depressible when the pin is radially aligned with the recess in the plug, and depression of the pin to a position inward of the shank permits axial removal of the cylinder and the outer knob shell.

2. A front-loaded knob assembly as claimed in claim 1 wherein the recess in the plug contains spring means which urges the retaining pin means outwards, the spring means having a cover on its outer end against which the inner end of the pin bears when the recess and pin means are in radial alignment and the pin is depressed.

* * * * *